US006046707A

United States Patent [19]

Gaughan et al.

[11] Patent Number: 6,046,707

[45] Date of Patent: Apr. 4, 2000

[54] CERAMIC MULTILAYER HELICAL ANTENNA FOR PORTABLE RADIO OR MICROWAVE COMMUNICATION APPARATUS

[75] Inventors: Frank J. Gaughan, Poway; Aki Nomura, San Diego; Kiyoshi Hatakeyama, La Jolla; John Washington McCoy, San Diego; Yoichi Hamano, San Clemente, all of Calif.

[73] Assignee: Kyocera America, Inc., San Diego, Calif.

[21] Appl. No.: 08/887,412

[22] Filed: Jul. 2, 1997

[51] Int. Cl.[7] ..... H01Q 1/36; H01Q 1/40; H01Q 1/42

[52] U.S. Cl. ..... 343/895; 343/873; 343/872

[58] Field of Search ..... 343/895, 873, 343/700 MS, 872; 336/83

[56] References Cited

U.S. PATENT DOCUMENTS

| | | | |
|---|---|---|---|
| 3,292,544 | 12/1966 | Caldwell et al. | 343/872 |
| 3,812,442 | 5/1974 | Muckelroy | 336/86 |
| 3,823,403 | 7/1974 | Walter et al. | 343/708 |
| 4,131,893 | 12/1978 | Munson et al. | 343/700 MS |
| 4,322,698 | 3/1982 | Takahashi et al. | 333/184 |
| 4,401,988 | 8/1983 | Kaloi | 343/700 MS |
| 4,873,757 | 10/1989 | Williams | 29/602.1 |
| 5,032,815 | 7/1991 | Kobayashi et al. | 336/83 |
| 5,250,923 | 10/1993 | Ushiro et al. | 336/83 |
| 5,334,821 | 8/1994 | Campo et al. | 235/380 |
| 5,373,300 | 12/1994 | Jenness et al. | 343/102 |
| 5,373,303 | 12/1994 | D'Hont | 343/788 |
| 5,406,063 | 4/1995 | Jelen | 235/472 |
| 5,408,077 | 4/1995 | Campo et al. | 235/380 |
| 5,408,078 | 4/1995 | Campo et al. | 235/380 |
| 5,450,090 | 9/1995 | Gels et al. | 343/700 MS |
| 5,497,164 | 3/1996 | Croq | 343/700 MS |
| 5,520,470 | 5/1996 | Willett | 400/88 |
| 5,541,610 | 7/1996 | Imanishi et al. | 343/702 |
| 5,764,197 | 6/1998 | Tsuru et al. | 343/895 |

FOREIGN PATENT DOCUMENTS

| | | | |
|---|---|---|---|
| 701262A1 | 11/1995 | European Pat. Off. | H01F 17/00 |
| 548320 | 2/1993 | Japan | H01Q 19/12 |
| 5191130 | 7/1993 | Japan | H01Q 11/08 |
| 6120727 | 4/1994 | Japan | H01Q 21/06 |
| 6290954 | 10/1994 | Japan | H01Q 17/00 |

OTHER PUBLICATIONS

A New Type Duplexer with Strip Line Filler, 1996 IEEE 46th Vehicular Tech. Conf. Mobile Technolgy for the Human Race, Atlanta Ga, by Yoshio Okada, Osamu Osawa, Tomokazu Komazaki,Katshiko Cunji.

Small Helical Antenna Made Of High–Temperature Superconducting Thick Film, *Journal of Superconductivity,* vol. 4 No. 6, 1991, by Keiichiro Itoh, Osamu Ishii, Yasuhiro Koshimoto and Keizo Cho.

Development of High Reliability Planar Chip Inductors, *Electrical Manufacturing and Coil Winding Conference*, (Sep. 27, 1994) by H.W. Swanson, Jr. (Published Aug. 1994).

*Primary Examiner*—Don Wong
*Assistant Examiner*—Jennifer H. Malos
*Attorney, Agent, or Firm*—Loeb & Loeb, LLP

[57] ABSTRACT

A small and durable antenna for use with radio and microwave communications is formed as a helical conductor contained in a multilayered non-ferrite ceramic chip. The dielectric constant of the ceramic is selected to match the antenna to its operating frequency, which may be in the range of 0.5 to 10.0 Gigahertz. A process for making such antennas is also disclosed. The antenna may be used in portable terminals and other devices requiring small, durable and inexpensive antennae.

20 Claims, 4 Drawing Sheets

CERAMIC MULTILAYER HELICAL ANTENNA FOR PORTABLE RADIO OR MICROWAVE COMMUNICATION APPARATUS

BACKGROUND OF THE INVENTION

1. Field of the Invention

The present invention relates to the field of radio or microwave frequency antennas; more specifically, the present invention relates to compact ceramic-embedded antennas suitable for use with apparatus using radio or microwave communication.

2. Description of Problem Sought to be Solved

Many portable devices in use today rely on radio communications to receive and transmit information. Examples of such devices include pagers, cellular telephones, automobile phones, wireless telephones, GPS (Global Positioning Satellite) receivers, portable terminals, personal computers, walkie talkies, baby monitors, and the like. This list is by no means exhaustive and the use of radio and microwave communications for portable devices can only be expected to grow. For example, it is proposed to develop a network of satellites that will make possible the linking of personal computers with the Internet from any place on earth.

Devices that use radio or microwave communications require antenna systems in order to couple their circuitry to the free space around them in order to receive and transmit information. In the past, wire or linear conductor antennas have been employed in such systems. Wire antennas may be coiled into helixes or spirals to reduce the overall length while maintaining a larger effective length. Such antennas frequently are in the form of dipole antennas in which the antenna forms one-half of the dipole and a circuit element, the casing or other metallic structure of the radio apparatus forms the other half of the dipole.

Wire or linear conductor antennas, however, are relatively large, bulky, and fragile. A need exists for antennas that are small, strong, and inexpensive, especially for use with the portable radio communication devices mentioned above.

Helical conductor antennas have been developed that are formed from laminated ferrite ceramic sheets bearing conductive segments on each sheet. The spiral conductive segments are electrically connected through the ferrite ceramic sheets in order to form the spiral conductive element, which is embedded or "potted" in the laminated ferrite ceramic sheets and is a quarter wavelength in effective length. See U.S. Pat. No. 5,541,610 to Imanishi, et al. for an "antenna for a radio communication apparatus." The antenna is miniaturized not only because it is helical but also because it is embedded in a ceramic material having a higher electrical permittivity ($\in$) and/or magnetic permeability ($\mu$) than that of free space ($\in_0,\mu_0$). It will be recalled that $$\lambda = \frac{c}{\nu\sqrt{\mu_r \epsilon_r}}$$

wherein $\lambda$=wavelength, c=speed of light in free space (vacuum), $\nu$=frequency, $\in_r = \in/\in_0$=relative electrical permittivity or dielectric constant and $\mu_r = \mu/\mu_0$=relative magnetic permeability of the medium of propagation. For a given frequency, an increase in the dielectric constant $\in_r$ and/or the relative magnetic permeability $\mu_r$ decreases the wavelength of electromagnetic radiation in the medium of propagation. The necessary length of the antenna in such a ceramic material is thus reduced.

Previous ceramic embedded antennas have employed the control of magnetic permeability by using ferrite ceramics. The effective length of the spiral conductive elements of these antennas was adjusted by changing the physical size of the spiral conductive element.

A need exists for an improved helical antenna which has low total volume, small dimensions, high mechanical strength, and can be manufactured by inexpensive and high volume manufacturing process. Such an antenna should be readily manufactured to be compatible with radio or microwave frequencies currently in use and likely to be used in the future, without necessarily changing the physical size of the antenna.

A need also exists for devices using radio or microwave communications, especially portable devices, that have improved antennas with the characteristics set forth above.

SUMMARY OF THE INVENTION

An improved antenna according to the invention meets these needs by providing a helical conducting element embedded in a block of non-ferrite ceramic. The dielectric constant of such a ceramic is readily controlled.

A helical antenna according to the invention may be comprised of a helical conducting element having two ends and embedded in a block principally composed of non-ferrite ceramic. At least one end of the conducting element reaches a surface of the block. The dielectric constant of the ceramic block may be selected to match the antenna to the operating frequency and may have a preselected value in the range of from about five to about forty, with a range of about five to about ten being preferred. The dielectric constant of the ceramic is varied by the choice and composition of the ceramic.

A helical antenna according to the invention may be formed of conducting segments printed or screened in predetermined positions and orientations onto ceramic sheets laminated into a stack. The conducting segments, which may be shaped like arcs or segments of an annulus, are electrically and sequentially connected to form a conductive element in the shape of a helix.

The antenna according to the invention is suitable for use at frequencies in the range of about 0.5 GHz to about 10.0 GHz, with the range of about 0.8 GHz to about 3 GHz currently being preferred.

Methods of constructing ceramic inductors may be used to construct antennae according to the invention. A currently preferred and novel method of making helical antennas includes the steps of:

a. preparing a ceramic green tape;
b. punching guideholes at predetermined locations in the ceramic green tape;
c. punching via-holes at predetermined locations in the ceramic green tape;
d. filling the via-holes with a conductive paste containing tungsten, gold, molybdenum, copper or other conductive metal;
e. printing conductive paste at predetermined locations and orientations on the ceramic green tape to form conductive segments;
f. laminating and compressing multiple ceramic green tapes in a predetermined order while using the guideholes to complete and check the alignment of the tapes;
g. cutting the laminated ceramic green tapes into stacks, each stack comprised of ceramic green sheets bearing conductive segments sequentially and conductively joined to form a helical conductive element; and h. firing the stacks in a controlled atmosphere to sinter the ceramic sheets, the conductive paste, and the conductive segments.

The method may include the further step of plating the antenna's exterior electrical connection with gold, nickel, tungsten, and/or other metals.

According to another aspect of the invention, a radio or microwave apparatus comprises a housing containing radio or microwave circuitry and an antenna as described above. The antenna may be mounted outside the housing of the radio or microwave apparatus, preferably with a protective dielectric housing covering it. This will be necessary if the housing of the radio or microwave apparatus is metallicized or is made of metal. Alternatively, an antenna as described above may be mounted inside the radio or microwave apparatus if the housing is not made of metal or metallicized. The antenna may then be mounted on a circuit board within the housing of the radio or microwave apparatus.

DETAILED DESCRIPTION OF THE PREFERRED EMBODIMENTS

Figure 1:
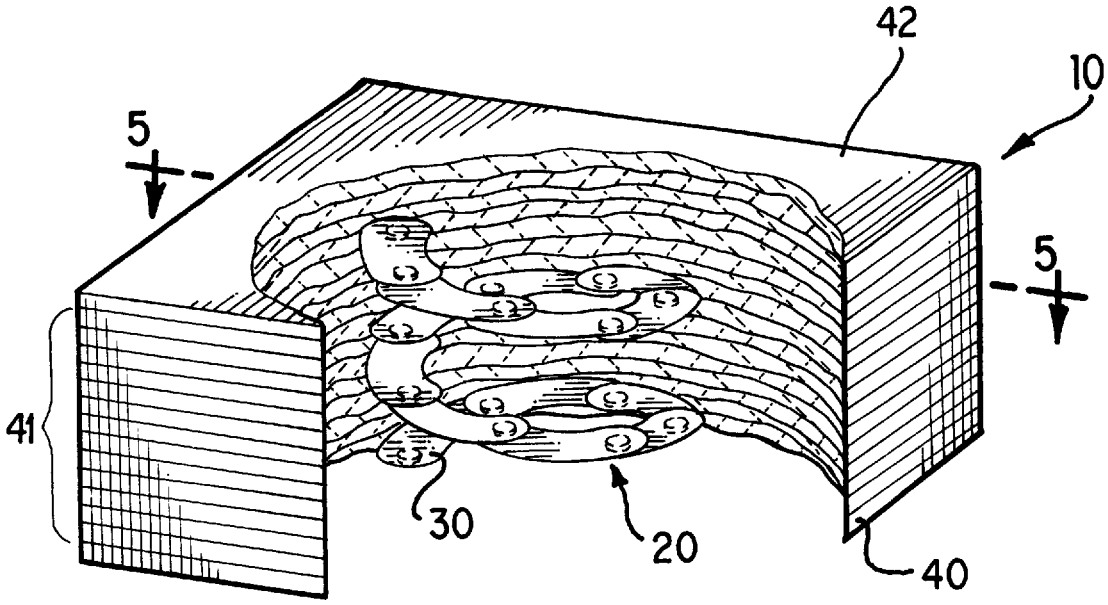
FIG. 1 shows a perspective view of an antenna according to one embodiment of the invention, with a cutaway showing the conductor segments.

A preferred embodiment of a helical antenna 10 according to the invention is shown in FIG. 1. A conducting element 20, in the form of a helix, is embedded in a ceramic block formed by a laminated stack of sheets 40, 41, and 42. The top sheet is indicated by reference numeral 42, the middle sheets by reference numeral 41, and the bottom sheet by reference numeral 40.

In one preferred embodiment, the sheets are principally (greater than 85% by weight) comprised of alumina ($Al_2O_3$). The alumina sheets contain one or more minor ingredients or additives selected to determine the dielectric constant of these sheets and alter the effective length of the antenna 10 for emitting or receiving radio or microwave frequency radiation. Alumina will henceforth refer to a ceramic that is principally made of $Al_2O_3$, with additives to alter the dielectric constant if required, unless the context indicates otherwise.

Other non-ferrite ceramics may be employed instead of alumina, such as chromium oxide ($Cr_2O_3$), titanium oxide ($TiO_2$), beryllium oxide (BeO), forsterite ($Mg_2SiO_4$), mullite, barium titanate ($BaTiO_3$), aluminum nitride (AlN), and others that will be known to those of skill in the art. The choice of non-ferrite ceramic will depend in part on the desired dielectric constant. Such non-ferrite ceramics may have additives included to adjust their dielectric constant to a desired value. The preferred embodiment described in reference to the drawings uses alumina but it should be understood that other non-ferrite ceramics may be employed in an antenna according to this invention.

Figure 5:
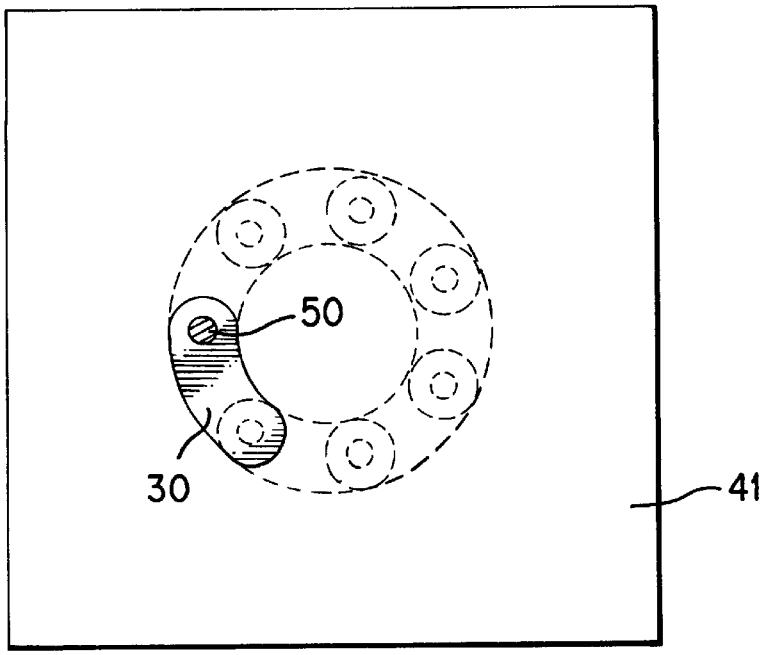
FIG. 5 shows a sectional view of the antenna of FIG. 1.

Each of the alumina sheets 40 and 41, but not the top-most sheet 42, bears a thin metallic or conductive arc-shaped conductive segment 30 thereon. As is best shown in FIG. 5, the conductive segments 30 are individually curved so that a smoothly curving helical conductive element 20 will be formed (albeit stepped due to the laminar construction). The conductive element 20 will have the appearance of an annulus when viewed (such as by x-ray imaging) from one end (see FIG. 5). Each conductive segment 30 is preferably made of tungsten or molybdenum when the non-ferrite ceramic of the sheets is alumina.

The conducting segments 30 are sequentially and conductively linked to each other by conductive or metallic material filling the via-holes 50 in the alumina sheets 41, and to the bottom of the antenna 10 by conductive material in the via-hole 50 in the alumina sheet 40. The conductive material in the via-holes 50 preferably is tungsten or molybdenum when the non-ferrite ceramic of the sheets is alumina.

Figure 2:
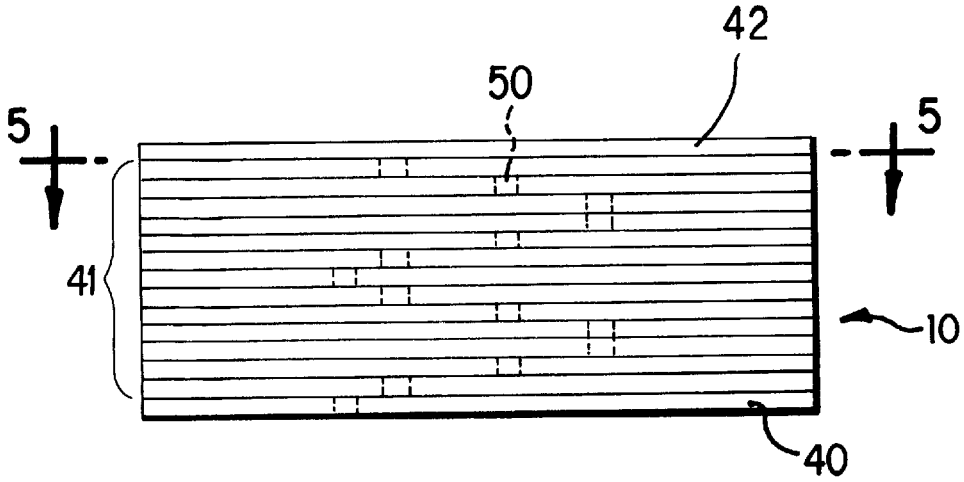
FIG. 2 shows a side view of the antenna of FIG. 1.

The via-holes 50, filled with the conductive material that connect the conductive segments 30, are best seen in FIG. 2, which is a view of the side of the antenna shown in FIG. 1. The laminated structure of the antenna 10 is disclosed in FIG. 2 as a stack of alumina sheets 40 and 41, each sheet bearing a conductive segment 30 printed thereon, and the top-most alumina sheet 42, which does not bear a conductive segment 30.

Figure 3:
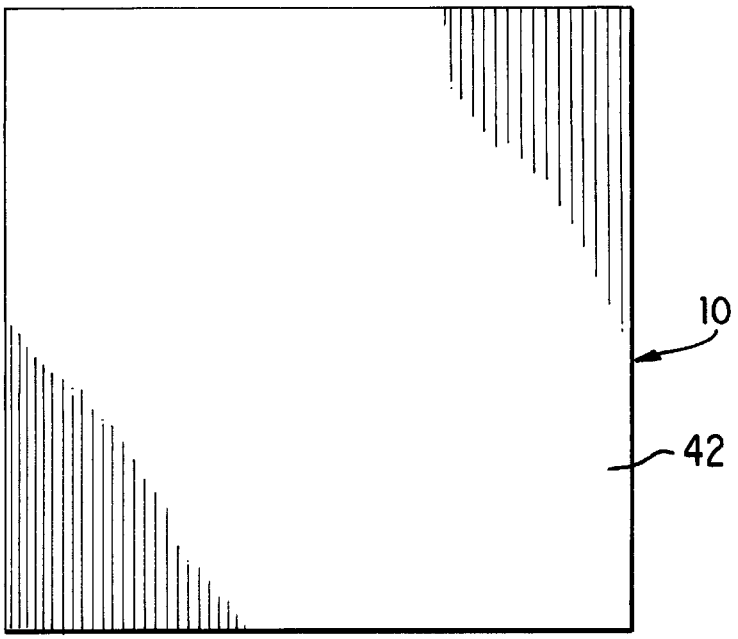
FIG. 3 shows a top view of the antenna of FIG. 1.

FIG. 3 is a top view of the antenna 10. The alumina sheet 42 lacks a via-hole 50 filled with conductive material.

Figure 4:
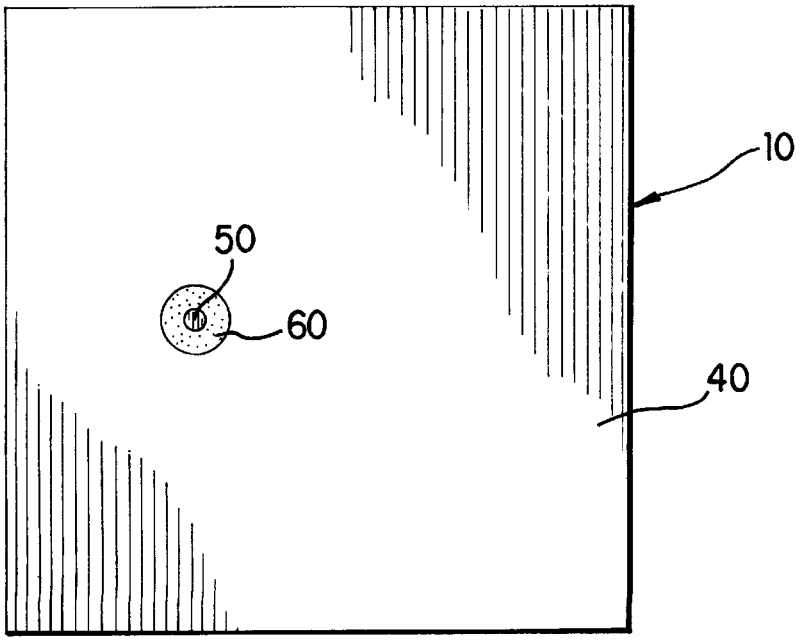
FIG. 4 shows a bottom view of the antenna of FIG. 1.

FIG. 4 is a bottom view of the antenna 10. The bottom of the alumina sheet 40 is shown together with a via-hole 50 that is filled with conductive material and a printed conducting ring or areola 60 that electrically communicates with the conductive material in the via-hole 50. (The conducting ring 60 may be printed over the conductive material in the via-hole 50 and may be made of gold plated over tungsten).

The purpose of the conducting ring or areola 60 on the bottom of the antenna 10 is to provide an electrical connection with radio or microwave circuitry in order to receive and/or transmit radio or microwave frequency electromagnetic energy.

In general, the effective length of the helical antenna according to the invention will be a fraction of a wavelength of the radio or microwave frequency radiation that will be transmitted or received by the antenna. Typically, the antenna should have an effective length of approximately one-fourth of a wavelength. For a given overall size of the antenna 10 (and the conducting element 20) the non-ferrite ceramic may be selected so that dielectric constant of the ceramic at the desired operating frequency may be higher or lower (without appreciably changing the relative magnetic permeability), in order to reduce or increase the size of the wavelength of the electromagnetic radiation that will be received or emitted by the antenna at the maximum gain, so that the effective length of the antenna is appropriate for the desired operating frequency.

Additives such as CaO, MgO, and $SiO_2$ may therefore be included in the ceramic of the sheets 40, 41, and 42 in order to adjust the dielectric constant to a pre-selected value. By such means the dielectric constant of the alumina may be tailored to any value in the range of about eight to about eleven. The preferred range for alumina is from about nine to about ten.

Other non-ferrite ceramics may be chosen in place of alumina if lower or higher dielectic constants are needed. An advantage of non-ferrite ceramics is that by the use of such ceramics a dielectric constant in the range of about 5 to about 40 can be achieved, whereas the available range of dielectric constants for ferrite ceramics is more limited. A preferred range for the dielectric constant of the non-ferrite ceramic used in this invention is from about 5 to about 10.

Other non-ferrite ceramics may be employed that have dielectric constants outside the range obtainable using alumina. Alumina glass ceramics that include silica could be employed if a lower dielectric constant (such as 5) is needed. Titanium oxide ($TiO_2$) could be used if a higher dielectric constant, such as 40, is necessary. Additives may be included in such ceramics in order to adjust the dielectric constant to the desired value, as discussed above in connection with alumina.

By appropriate selection of the thickness and number of the sheets 40, 41, and 42, the diameter of the helix formed by the conductive element 20, and the dielectric constant of the sheets, the effective length of the conductive element 20 of the helical antenna 10 can be varied so that the radio or microwave frequency at which the antenna has the most gain (resonant frequency) can be varied from about 0.5 GHz to about 10.0 GHz, although the range that is currently preferred is about 0.8 to about 3.0 GHz. The dielectric constant of the non-ferrite ceramic sheets can be varied while maintaining the other dimensions of the antenna 10 constant, thus permitting the production of antennae of a uniform size but different resonant frequencies.

An example of an antenna 10, with dimensions and compositions, is described with reference to FIGS. 1–5. The antenna 10 has fifteen sheets 40, 41, and 42 made of 90% black alumina, which has the composition stated in the following table:

| COMPONENT | PERCENT BY WEIGHT |
|---|---|
| $Al_2O_3$ | 90% |
| $SiO_2$ + MgO + CaO | 10% |

Each alumina sheet is 0.152 mm (0.006 inches) thick.

The conducting segments 30 printed on fourteen of the alumina sheets (sheets 40 and 41) are made of tungsten with a minimum thickness of 10 microns. The conductive segments 30 are arc-shaped segments 30 with a width radially (i.e., along a radius of the helix) of 0.635 mm (0.025 inches). Each conductive segment 30 subtends an angle of 51.4° in relation to the central axis of the two-turn helix described by the conductive element 20, the angle being measured between the axes of the via-holes in the underlying alumina sheet and the overlying alumina sheet that are in contact with the conductive segment 30.

The via-holes 50 are 0.254 mm (0.01 inches) wide or in diameter and the axis of each via-hole 50 is located 1.346 mm (0.053 inches) from the central axis of the helix described by the conductive element 20. The conductive material filling the via-holes 50 is tungsten.

The areola 60 printed on the alumina sheets 40 is 1.27 mm (0.050 inches) in diameter and is gold over tungsten with a minimum thickness of 1.524 microns (60 micro inches).

The overall dimensions of this example of the antenna 10 are height: 2.29 mm (0.090 inches), width: 4.85 mm (0.191 inches), and length: 4.85 mm (0.191 inches).

The dielectric constant of the alumina sheets of this example of the antenna 10 is 9.6 (as measured at 1 MHz). The preferred or resonant frequency at which the antenna will operate is 2.45 GHz.

It will be understood by those skilled in the art that the conductive segments 30 can have other shapes than the shapes depicted in FIGS. 1 and 5. For example, the conductive segments could be more angular, such as a series of right angle elbows. The helix described by the conductive element 20 need not be a perfect helix in which each portion is at the same radius from the longitudinal axis of the helix. It will also be understood that the antenna 10 need not be rectangular. For example, it could be shaped as a cylinder.

An antenna according to the invention may be made by any process suitable for making chip or ceramic inductors, and such methods will be known to those skilled in the art. An example of such a method is shown in U.S. Pat. No. 3,812,442 to Muckelroy for a "ceramic inductor," the disclosure of which with respect to methods of making ceramic inductors is incorporated explicitly by reference.

A preferred and novel method of making helical antennas according to the invention is described below.

First, non-ferrite ceramic green tapes are prepared. The non-ferrite ceramic of the green tapes could be alumina having a composition as described above, with a binding agent that will be eliminated during the later firing step. The ceramic green tapes may be formed with a backing that will be removed before the lamination step.

Second, one or more guideholes are punched at preselected positions in the tapes.

Third, the via-holes 50 are punched at preselected positions in the tapes. The second and third steps may be reversed in sequence or performed simultaneously.

Fourth, the via-holes 50 are filled with metal or conductive paste for later conductive interconnection between the sheets or layers of the assembled antenna. The metal paste may be made of a combination of glass, a metal powder appropriate for the chosen ceramic (such as tungsten or molybdenum for alumina), and a carrier.

Fifth, metal or conductive paste is screened or printed at preselected positions and orientations on the tapes to form one or more conductive segments 30. The metal paste may be made of a combination of glass, a metal powder appropriate for the chosen ceramic (such as tungsten or molybdenum for alumina), and a carrier. The metal paste for the conductive segments 30 is printed over the metal paste in the via-holes 50. Each tape may contain at least as many conductive segments as the number of antennae to be made.

Sixth, the tapes formed according to the above steps are laminated and compressed one on top of each other in a predetermined order so that the conductive segments, joined by the metal paste in the via-holes 50, together form conductive elements in the form of helixes. The guideholes, with the aid of a pin or pins, are used in this step to align the laminated tapes.

Seventh, the laminated tapes are cut into stacks of ceramic green sheets, each stack containing a conductive element, and the stacks are trimmed into pre-firing form.

Eighth, the stacks are fired in a controlled atmosphere such as nitrogen ($N_2$) and hydrogen ($H_2$). The purpose of the controlled atmosphere is to prevent oxidation of the metallic components, such as the metal paste of the conductive segments and the metal paste filling the via-holes. The ceramic green sheets and the metal paste of the conductive segments and the metal paste filling the via-holes will be sintered during this step.

Ninth, and optionally, the bottom of each fired stack is plated with a metal, such as gold over tungsten, over and/or around a via-hole containing sintered metal paste and connecting to the outside of the stack, in order to form a conducting areola for electrical connection with the conductive element inside each stack.

Antennas (or inductors) could be made with any non-ferrite ceramics of the kinds described above, including alumina, using the method described above.

Figure 6:
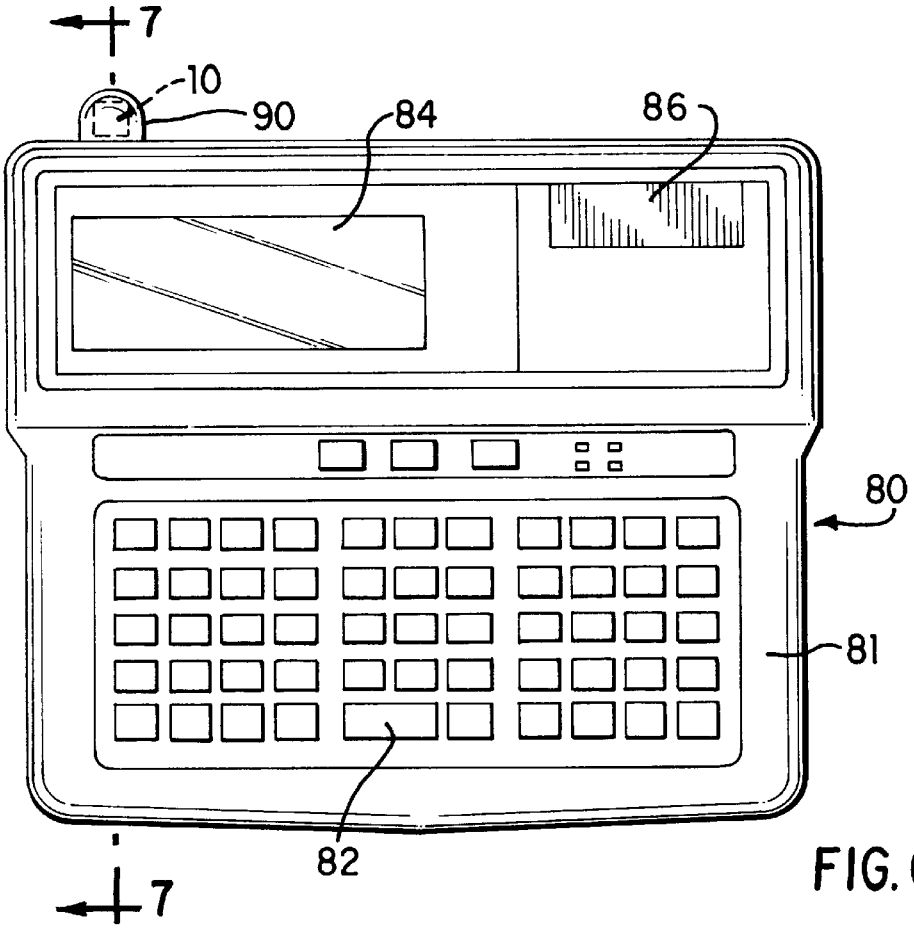
FIG. 6 shows a top view of a radio apparatus (a portable terminal) according to another embodiment of the invention, with the antenna of FIG. 1 externally mounted thereon.
Figure 7:
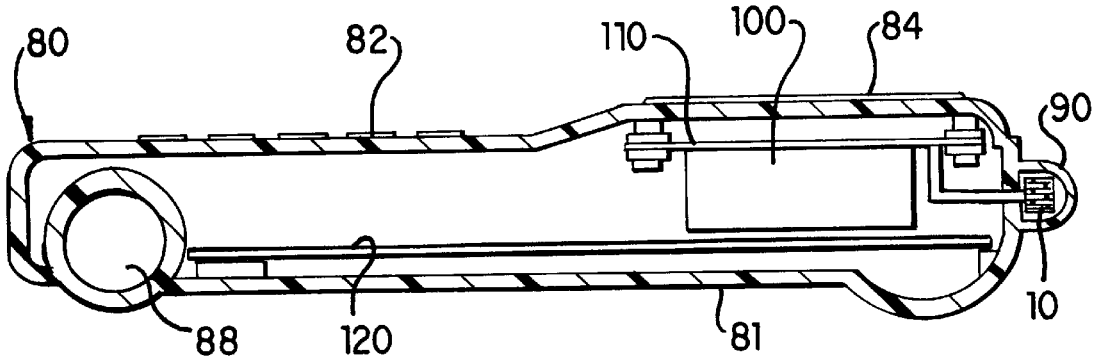
FIG. 7 shows a sectional view of the portable terminal of FIG. 6.
Figure 8:
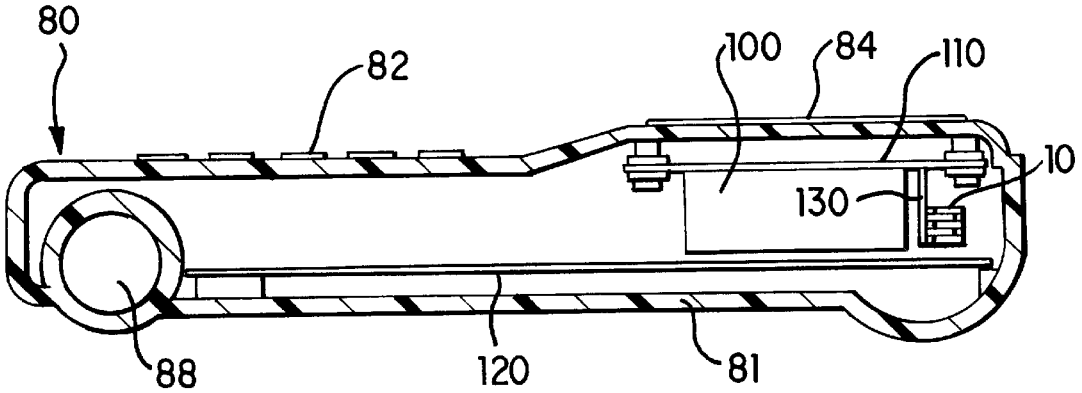
FIG. 8 shows a sectional view of an alternative embodiment of a radio apparatus according to the invention in which the antenna of FIG. 1 is mounted internally.

The antenna according to the invention can be used as part of an apparatus that uses communication by radio or microwave frequency electromagnetic radiation. FIGS. 6 through 8 depict an embodiment of a mobile or portable terminal using an antenna according to the invention.

The portable terminal shown in FIGS. 6 through 8 is a portable computer terminal 80 having a housing 81 which may be made of a thermoplastic. This terminal is used, for example, to record purchases or to arrange transactions such as renting cars. It has a keyboard or touch pad 82, a display screen 84, and a signature screen 86 which records handwritten signatures. An example of such a portable computer terminal is shown in U.S. Pat. No. 5,334,821 to Campo, et al. for a "portable point of sale terminal," the disclosure of which is explicitly incorporated by reference.

In FIG. 6 an antenna 10 according to the invention is shown mounted within a protective weatherproof cover 90 on the exterior of the housing 81 of the portable terminal 80. The cover 90 is made of a dielectric such as a thermoplastic and protects the antenna 10 from exterior hazards.

FIG. 7 shows a cross section of this embodiment of the portable terminal 80. A metallic compartment 100 mounted on circuit board 110 within the housing 81 contains the radio circuitry. The battery compartment 88 contains batteries (not shown) for the power supply of terminal 80. The circuit board 120 mounts other components of the portable terminal 80, such as a microprocessor and memory components (not shown).

The antenna 10 must be mounted on the exterior of the housing 81 of the portable terminal 80 when the interior of the housing 81 metallicized or the housing 81 is itself made of metal. In this case, the metal housing 81 or the metallic layer on the housing 81 can serve as the other half of a dipole antenna, the antenna 10 forming the first half.

Alternatively, if the housing is made of a dielectric such as a thermoplastic, the antenna 10 may be mounted inside the housing 81 of the portable terminal 82. In the alternative cross section shown in FIG. 8 the antenna 10 is mounted on a circuit board 130 which is in turn mounted normal to the circuit board 110. In this case, the metallic container 100 for the radio circuitry can serve as the other half of the dipole antenna or some other suitably large conductive component within the portable terminal could serve that purpose. See U.S. Pat. No. 5,541,610 to Imanishi, et al. for an "antenna for a radio communication apparatus," the disclosure of which is explicitly incorporated by reference.

It will be understood to those skilled in the art that many other apparatus using radio or microwave frequency communication could be employed with an antenna according to the invention, such as pagers, mobile telephones, portable computers and the like.

Various alterations, modifications, and improvements of the invention will readily occur to those skilled in the art in view of the particular embodiments described above. Such alternations, modifications, and improvements are intended to be part of this disclosure and are intended to be within the spirit and scope of this invention. Accordingly, the foregoing descriptions are by way of example, and are not intended to be limiting. The invention is limited only as defined in the following claims and the equivalents thereof.

What is claimed is:

1. An antenna for transmitting/receiving radio wave or microwave electromagnetic radiation, comprising:

a plurality of sheets stacked upon one another to form a stack, the sheets being principally comprised of non-ferrite ceramic, the ceramic having a dielectric constant with a preselected value in the range of from about 5 to about 40; and conductive segments carried separately on the ceramic sheets and sequentially and electrically connected to each other so as to form a multilayer conductive element extending helically within the stack of sheets; wherein the conductive segments are arc-shaped so that the conductive element curves smoothly and has the appearance of an annulus when viewed from an end of the conductive element.

2. The antenna according to claim 1 in which the range of the dielectric constant of the block is from about 5 to about 10.

3. The antenna according to claim 1 in which the dielectric constant of the ceramic is selected in accordance with a predetermined length of the conductive element so that the conductive element has an equivalent length equal to a predetermined portion of a wavelength in the ceramic of electromagnetic radiation of a selected frequency.

4. The antenna according to claim 1 in which the effective length of the conductive element is a predetermined fraction of a wavelength of electromagnetic radiation in the ceramic, at a frequency in the range of about 0.5 to about 10.0 Gigahertz.

5. The antenna according to claim 4 in which the range of frequencies is about 0.8 to about 3.0 Gigahertz.

6. The antenna according to claim 1 in which the non-ferrite ceramic is selected from the group consisting of alumina, chromium oxide, titanium oxide, beryllium oxide, forsterite, mullite, barium titanate, and aluminum nitride.

7. The antenna according to claim 6 in which the block further comprises at least one additive for changing the dielectric constant of the block.

8. The antenna according to claim 7 in which the additive is selected from the group consisting of calcium oxide, magnesium oxide, and silicon dioxide.

9. The antenna according to claim 1 in which the conductive segments are electrically connected to each other by conductive material filling via-holes extending through the sheets to join adjacent conductive segments.

10. An apparatus for receiving and/or sending information by means of radio or microwave frequency electromagnetic waves, comprising:

a housing;

radio or microwave circuitry mounted in the housing; and an antenna in accordance with claim 1 for receiving or transmitting radio or microwave frequency electromagnetic radiation.

11. The apparatus according to claim 10 in which the antenna is mounted on the exterior of the housing.

12. The apparatus according to claim 11 further comprising a dielectric cover for enclosing the antenna, the dielectric cover being attached to the housing and protecting the antenna from exterior hazards.

13. The apparatus according to claim 10 in which the antenna is mounted inside the housing.

14. The apparatus according to claim 10 further comprising a keyboard, a display, a microprocessor, a memory, and a self-contained power supply supported by the housing, the microprocessor electrically communicating with the radio or microwave circuitry and with the keyboard, the display, the memory, and the power supply so that the apparatus can be used as a mobile terminal.

15. A method of making multilayer ceramic-embedded helical antennas, comprising the steps of:

a. preparing non-ferrite ceramic green tapes;

b. punching guideholes at predetermined intervals in the non-ferrite ceramic green tapes;

c. punching via-holes at predetermined locations in the non-ferrite ceramic green tapes;

d. filling the via-holes with a conductive paste;

e. printing conductive segments at predetermined locations and orientations on the non-ferrite ceramic green tapes, each conductive segment being printed so that it is contacting the conductive paste in a via-hole;

f. laminating the non-ferrite ceramic green tapes in a predetermined order, using the guideholes to complete and check the alignment of the non-ferrite ceramic green tapes;

g. cutting the laminated non-ferrite ceramic green tapes into stacks, each stack containing conductive segments linked sequentially and electrically by the conductive paste in the via-holes to form an embedded helical conductive element; and h. firing the stacks in a controlled atmosphere to sinter the non-ferrite ceramic green tapes, the conductive paste, and the conductive segments.

16. The method according to claim 15 further comprising the step of shaping the stacks before the step of firing.

17. The method according to claim 15 further comprising the step of compressing the laminated ceramic green tapes before the step of cutting them into stacks.

18. The method according to claim 15 in which the ceramic is chosen from the group consisting of alumina, chromium oxide, titanium oxide, beryllium oxide, forsterite, mullite, barium titanate, and aluminum nitride.

19. The method according to claim 15 in which the ceramic is selected so that its dielectric constant is a predetermined value.

20. The method according to claim 19 in which the predetermined value of the dielectric constant of the ceramic is in the range of about 5 to about 40.

* * * * *